US005270501A

United States Patent [19]

Murahashi et al.

[11] Patent Number: 5,270,501

[45] Date of Patent: Dec. 14, 1993

[54] COPPER-BASED SINTERED ALLOY ELECTRODE FOR USE IN IGNITION DISTRIBUTOR OF INTERNAL COMBUSTION ENGINE

[75] Inventors: Noriaki Murahashi, Omiya; Yutaka Ohashi, Himeji; Tohru Kohno, Omiya, all of Japan

[73] Assignees: Mitsubishi Materials Corporation; Mitsubishi Denki Kabushiki Kaisha, both of Tokyo, Japan

[21] Appl. No.: 861,442

[22] Filed: Apr. 1, 1992

[30] Foreign Application Priority Data

Apr. 1, 1991 [JP] Japan ..... 3-94799

[51] Int. Cl.[5] ..... H01H 19/00; H01H 1/00; F02P 7/02

[52] U.S. Cl. ..... 200/19 DR; 200/19 DC; 200/266

[58] Field of Search ..... 200/19 R, 19 DC, 19 DR, 200/262-268

[56] References Cited

U.S. PATENT DOCUMENTS 4,007,342 2/1977 Makino et al. ..... 200/19 R
4,091,245 5/1978 Komiyama et al. ..... 200/19 R
4,217,470 8/1980 Kirner ..... 200/19 R
4,270,266 6/1981 Lanzi et al. ..... 200/19 DR X
4,565,907 1/1986 Takahashi et al. ..... 200/19 DR
5,134,257 7/1992 Oka et al. ..... 200/19 DR

FOREIGN PATENT DOCUMENTS 51-38852 10/1976 Japan .
55-78173 6/1980 Japan .
58-28427 6/1983 Japan .

*Primary Examiner*—J. R. Scott
*Attorney, Agent, or Firm*—Oblon, Spivak, McClelland, Maier & Neustadt

[57] ABSTRACT

An electrode for an ignition distributor of an internal combustion engine is disclosed which is made of a copper-based sintered alloy. The alloy contains a copper matrix, and grains of $Al_2O_3$ having an average grain size of 10 to 100 μm. The $Al_2O_3$ grains are dispersed uniformly in the copper matrix at a ratio of from 45 to 60 percent by surface area as measured in an arbitrary cross-section. The electrode of this construction exhibits very low capacitive-discharge current peaks and starting voltages, and hence the generation of radio wave noise can be substantially eliminated.

1 Claim, 1 Drawing Sheet

COPPER-BASED SINTERED ALLOY ELECTRODE FOR USE IN IGNITION DISTRIBUTOR OF INTERNAL COMBUSTION ENGINE

BACKGROUND OF THE INVENTION

1. Field of the Invention

The present invention relates to an electrode of copper-based sintered alloy for use in an ignition distributor of an internal combustion engine, and in particular to an improved electrode which exhibits low capacitive-discharge current peaks and discharge starting voltages, thereby preventing radio wave noise from being generated.

2. Prior Art

Generally, in a known ignition distributor of an internal combustion engine, a high voltage stored in an ignition coil is transferred through a high voltage cable from a central terminal and led through a spring and a carbon electrode to a rotor electrode, to cause dielectric breakdown of air in the discharging gap between the tip end of the rotor electrode and each side fixed electrode, whereby the high voltage is discharged to the side fixed electrodes. The high voltage thus distributed is further led to spark plugs through high voltage cables. The aforesaid rotor electrode has conventionally been made of brass or stainless steel, while the side fixed electrodes have usually been made of aluminum.

Furthermore, it has been hitherto known that in the ignition distributor of an internal combustion engine as described above, radio wave noise is generated due to the current discharged between the rotor electrode and the side fixed electrode, and this disrupts radio broadcasts, television broadcasts and other communications. In order to prevent the generation of the radio wave noise, various kinds of electrodes have hitherto been proposed, as disclosed, for example, in Japanese Patent Application B-Publication, Serial No. 51-38852; Japanese Patent Application A-Publication, Serial No. 55-78173; and Japanese Patent Application B-Publication, Serial No. 58-28427.

However, all of the prior art electrodes have been constructed so as to have insulating layers on their surfaces, and these layers are susceptible to separation. This problem of separation has especially been encountered in the case where the ignition distributor is made large in size or is improved so as to have superior performance. Thus, the prior art electrodes had drawbacks in their reliabilities.

SUMMARY OF THE INVENTION

It is therefore an object and feature of the present invention to provide a copper-based sintered alloy electrode for an ignition distributor of an internal combustion engine which is not provided with an insulating layer on its surface, so that the problem of separation of the insulating layer can be definitely overcome.

According to the present invention, there is provided an electrode for an ignition distributor of an internal combustion engine, the electrode being made of a copper-based sintered alloy which consists essentially of a copper matrix and grains of aluminum oxide having an average grain size of 10 to 100 μm, the aluminum oxide grains being uniformly dispersed in the copper matrix at a ratio of from 45 to 60 percent by surface area as measured in an arbitrary cross-section.

The electrode thus constructed exhibits a low capacitive-discharge current peak and discharge starting voltage, thereby preventing radio wave noise from being generated. In addition, since the electrode is formed by means of a usual metallurgical method, it has the same high strength as the prior art electrodes of brass or aluminum have.

DESCRIPTION OF THE INVENTION

Figure 1:
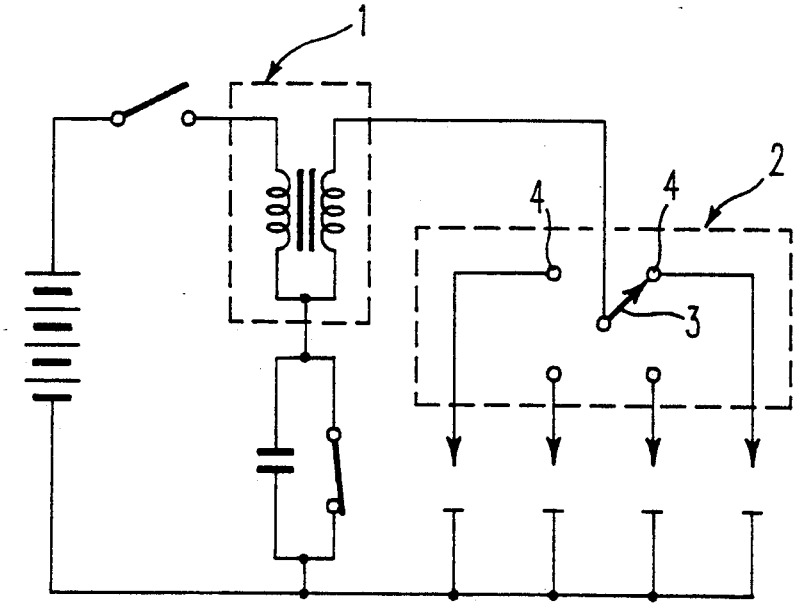
FIG. 1 PRIOR ART
FIG. 1 is a circuit diagram of a conventional ignition distributor.

After an extensive study relating to the improvement of the prior art electrodes as previously described, the inventors have concluded that if an electrode is made of a copper-based sintered alloy which consists of a copper matrix and grains of aluminum oxide having an average grain size of 10 to 100 μm and dispersed uniformly in the copper matrix at a ratio of from 45 to 60 percent by surface area as measured in an arbitrary cross-section, the resulting electrode exhibits desirable properties. Thus, the electrode for an ignition distributor of an internal combustion engine in accordance with the invention is characterized in that it is made of a copper-based sintered alloy which consists essentially of a copper matrix and grains of aluminum oxide ($Al_2O_3$) having an average grain size of 10 to 100 μm and dispersed uniformly in the copper matrix at a ratio of from 45 to 60 percent by surface area as measured in an arbitrary cross-section.

The aforesaid numerical ranges of the average grain size and dispersion ratio of the $Al_2O_3$ grains have been empirically determined. However, if either the average grain size or the dispersion ratio falls outside the above respective range, no significant reduction in either the capacitive-discharge current peaks or the discharge starting voltages can be attained, and hence the generation of the radio wave noise cannot be efficiently prevented.

The present invention will now be described in more detail by way of the following example:

EXAMPLE

Copper powder having an average particle size no greater than 100 μm, and various kinds of $Al_2O_3$ powder having a prescribed average particle size ranging from 5 to 110 μm, were prepared and blended in various predetermined compositions. Thereafter, the powders were mixed under usual conditions and pressed under a pressure of 5 tons/cm$^2$ to form green compacts. Subsequently, the green compacts were subjected to sintering by being held in a hydrogen atmosphere at a temperature of 950° C. for a period of 1 hour to provide copper-based sintered alloy electrodes 1 to 10 of the invention, as well as comparative copper-based sintered alloy electrodes 1 to 4. All of the electrodes thus formed were rotor electrodes for use in an ignition distributor of an internal combustion engine, and had shaft widths of 4 mm, flange widths of 22.5 mm, lengths of 43 mm and thicknesses of 1.2 mm. Furthermore, in the comparative electrodes, the average particle sizes or dispersed ratios of $Al_2O_3$ grains were outside the ranges of the invention.

As to each of the electrodes thus obtained, a theoretical density ratio of the copper-based sintered alloy thereof, and the average grain size and dispersed ratio of $Al_2O_3$ grains in the matrix, were respectively measured. The results are set forth in Table 1.

Moreover, the various electrodes obtained as described above were attached to a conventional ignition distributor circuit as disclosed in Japanese Patent Application, B-Publication, Serial No. 51-38852.

FIG. 1 depicts a prior art circuit containing an ignition coil 1, a distributor 2, a rotor electrode 3, and a side fixed electrode 4.

Figure 2:
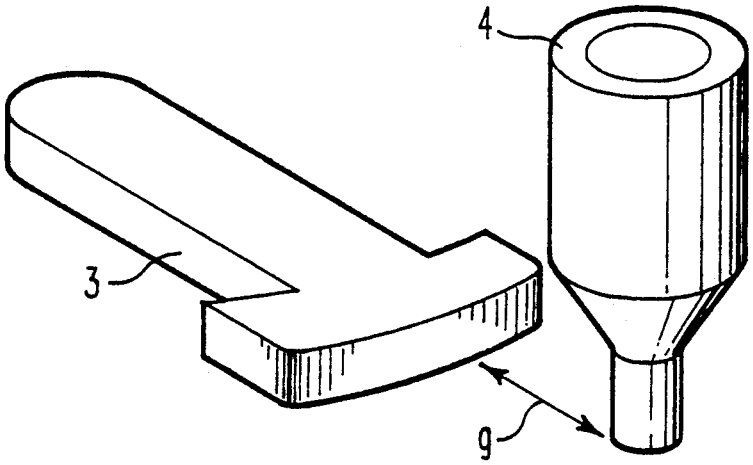
FIG. 2 is a isometric view of a rotor electrode and a side fixed electrode.

FIG. 2 depicts a rotor electrode 3 and a side fixed electrode 4 separated by a gap g.

A distributor was operated under the following conditions:.

Side fixed electrode: made of aluminum

Gap between rotor electrode and side fixed electrode: 1 mm

Rotating speed of rotor electrode: 750 r.p.m.

Then, the capacitive-discharge current peaks and discharge starting voltages were measured at the center piece of the ignition distributor. The measured results are also set forth in Table 1. Furthermore, for comparison purposes, the measurement for the application of prior art rotor electrode of brass under the same conditions is also shown in Table 1.

As will be seen from Table 1, with respect to both of the capacitive-discharge current peaks and discharge starting voltages, the electrodes 1 to 10 of the invention exhibit very low values compared with the prior art brass electrode. Furthermore, in connection with the comparative electrodes 1 to 4, when either the average particle size of the $Al_2O_3$ grains or dispersed ratio thereof falls outside the desired range of the invention, no significant reduction in either the capacitive-discharge current peak or the discharge starting voltage can be attained.

Moreover, as to each of the aforesaid electrodes, the tensile strength was measured. As a result, the prior art brass electrode had a tensile strength of about 33 $kg/mm^2$, while the tensile strength of each electrode of the present invention ranged from 15 to 20 $kg/mm^2$. In this connection, the practical tensile strength for this sort of electrode is above 10 $kg/mm^2$. Therefore, although somewhat low as compared with the prior art brass electrode, the tensile strength of the electrode of the present invention is sufficiently high for industrial purposes.

In the foregoing example, the invention has been applied to the rotor electrodes. However, the invention could as well be applied to the side fixed electrodes.

As described above, the electrode in accordance with the present invention exhibits very low capacitive-discharge current peaks and starting voltages, and hence radio wave noise can be substantially prevented from being generated. Furthermore, inasmuch as the electrode of the invention is formed by the application of a usual metallurgical process, it has sufficient strength for practical use.

TABLE 1

| | Cu sintered alloy | | | Characteristics | |
|---|---|---|---|---|---|
| | | $Al_2O_3$ grains | | | |
| Kinds | Theoretical density ratio (%) | Average grain size (μm) | Dispersed ratio (surface %) | Capacitive discharge current peak (A) | Starting voltage (kV) |
| Electrodes of invention | | | | | |
| 1 | 91.2 | 10.4 | 54.2 | 1.7 | 5.5 |
| 2 | 93.0 | 20.1 | 59.8 | 1.6 | 5.0 |
| 3 | 94.2 | 29.7 | 47.0 | 2.4 | 6.0 |
| 4 | 93.9 | 41.0 | 59.1 | 1.7 | 5.3 |
| 5 | 94.2 | 49.5 | 48.7 | 2.5 | 6.1 |
| 6 | 94.5 | 60.8 | 52.3 | 2.2 | 5.8 |
| 7 | 94.3 | 70.2 | 55.6 | 1.9 | 5.5 |
| 8 | 95.1 | 80.3 | 46.2 | 2.7 | 6.2 |
| 9 | 94.7 | 89.8 | 50.7 | 2.1 | 5.9 |
| 10 | 94.8 | 99.3 | 56.8 | 2.0 | 5.6 |
| Comparative electrodes | | | | | |
| 1 | 84.2 | 7.3* | 53.1 | 4.9 | 8.0 |
| 2 | 95.0 | 107.2* | 55.4 | 8.6 | 10.8 |
| 3 | 95.4 | 93.1 | 31.4* | 9.2 | 11.7 |
| 4 | 79.2 | 12.8 | 63.6* | 5.2 | 8.1 |
| Prior art electrode | | | | | |
| made of brass | | | | 10.1 | 13.1 |

Symbols "*" denote values falling outside the claimed range of the invention.

What is claimed is:

1. An electrode for an ignition distributor of an internal combustion engine, said electrode being made of a copper-based sintered alloy consisting essentially of a copper matrix and grains of aluminum oxide having an average grain size of 10 to 100 μm, said aluminum oxide grains being uniformly dispersed in said copper matrix at a ratio of from 45 to 60 percent by surface area.

* * * * *